US005588571A

United States Patent [19]

Mazzo

[11] Patent Number: 5,588,571

[45] Date of Patent: Dec. 31, 1996

[54] WRIST WALLET AND CARRYING POUCH

[76] Inventor: Charles Mazzo, 10 Lachlan St., Liverpool, New South Wales, Australia, 2170

[21] Appl. No.: 582,089

[22] Filed: Jan. 2, 1996

Related U.S. Application Data

[63] Continuation-in-part of Ser. No. 305,446, Sep. 13, 1994, abandoned.

[30] Foreign Application Priority Data

Oct. 29, 1993 [AU] Australia ..... 50338/93

[51] Int. Cl.[6] ..... A45C 13/30; A45F 3/14

[52] U.S. Cl. ..... 224/222; 224/267; 224/236; 224/901.4; 150/136

[58] Field of Search ..... 224/218, 219, 224/220, 221, 222, 191, 235, 236, 267, 901, 901.2, 901.4, 901.6; 150/136, 143, 144, 132, 146; 383/88, 901; D3/215, 225, 226

[56] References Cited

U.S. PATENT DOCUMENTS

| | | | |
|---|---|---|---|
| 1,686,756 | 10/1928 | Lorber | 150/132 |
| 3,189,073 | 6/1965 | Todd | 224/219 |
| 4,209,048 | 6/1980 | Sandos | 150/132 |
| 4,905,881 | 3/1990 | Graber | 224/222 |
| 5,074,300 | 12/1991 | Murphy | 383/901 |

FOREIGN PATENT DOCUMENTS

| | | | |
|---|---|---|---|
| 624295 | 7/1981 | Switzerland | 224/224 |
| 507544 | 6/1939 | United Kingdom | 383/88 |

*Primary Examiner*—Henry J. Recla
*Assistant Examiner*—Gregory M. Vidovich

[57] ABSTRACT

A waterproof wallet and pouch combination adapted for use by an individual wherein the pouch can be securely worn around the wrist, with the wallet secured in the pouch in a substantially waterproof manner. The pouch is secured to the wrist by means of two straps which pass through rings on one side of the pouch and are secured in position by hook and loop type fasteners. When the back of the pouch is secured to the front of the pouch by hook and loop type fasteners, a section of the front of the pouch is folded back onto itself. The wallet contains a note compartment which runs the length of the wallet, and is divided into three sections along its length and is folded with one of the end sections being folded onto the middle section, and placed in the pouch.

4 Claims, 4 Drawing Sheets

WRIST WALLET AND CARRYING POUCH

This application is a continuation-in-part of application Ser. No. 08/305,446 filed 13 Sep. 1994 which is now abandoned.

BACKGROUND OF THE INVENTION

The present invention relates to a wallet and pouch combination which is adapted to be worn on the wrist of the user.

Carrying a conventional wallet can be inconvenient and uncomfortable for people when they are wearing sport attire or clothes without pockets. When wearing such clothes many people resort to carrying a conventional wallet in their hands or place the wallet in a position between their clothes and their body. Under such circumstances the conventional wallet is susceptible to being lost. Another problem is that the wallet can be damaged by sweat or by immersion in water.

SUMMARY OF THE INVENTION

The present invention seeks to ameliorate these disadvantages by providing a waterproof wallet and pouch combination, adapted to be worn around the wrist of a user;

wherein said pouch comprises: a front member; and a back member forming a cavity there between, said back member having an extension portion which extends on one side beyond the respective side of said front member and forming an opening into the cavity, along the respective side of said front member;

a first hook and loop type fastener located on the front of said extension portion of said back member;

a second hook and loop type fastener located on the front of said front member adjacent said opening of the pouch; whereby said hook and loop type fasteners releaseably seal to each other, with said extension portion of said back member folded over and sealing said opening, with a portion of said front member between said opening and said second hook and loop type fastener folding back on itself;

a third hook and loop type fastener located on the back of said extension portion of said back member;

a first strap, having a fourth hook and loop type fastener thereon, extending from one side edge of said extension portion of said back member;

a first ring member located on the other side edge of said extension portion of said back member;

a second strap being connected, adjacent its free ends, to said pouch, adjacent the side edges of said pouch, and extending free across the front of the front member of said pouch substantially parallel to said opening;

a fifth hook and loop type fastener located on said second strap;

a third strap having a sixth hook and loop type fastener thereon extending from one side edge of said pouch adjacent said second strap;

a second ring member located on the other side edge of said pouch adjacent said second strap;

whereby, in use, the back member of the pouch is against the wrist of the user, and the first strap passes through the first ring member with the fourth hook and loop type fastener thereon releasably secures to the third hook and loop type fastener, and the third strap passes through the second ring member, with the sixth hook and loop type fastener thereon releaseably secured to the fifth hook and loop type fastener, thereby securing the pouch to the wrist of the user;

wherein said cavity is adapted to removably hold said wallet therein, when the wallet is in its folded configuration, and wherein said wallet comprises three substantially equal in length flexible sections, extending along the length of the wallet, said sections being a first end section, a middle section, and a second end section; and said wallet further comprises a first compartment extending along all three sections, and at least a second compartment located on the first end section, whereby the wallet is in its folded configuration when said second end section is folded over the middle section.

BRIEF DESCRIPTION OF THE DRAWINGS

The present invention will now be described by way of example with reference to the accompanying drawings in which.

DETAILED DESCRIPTION OF AN EMBODIMENT

Figure 1:
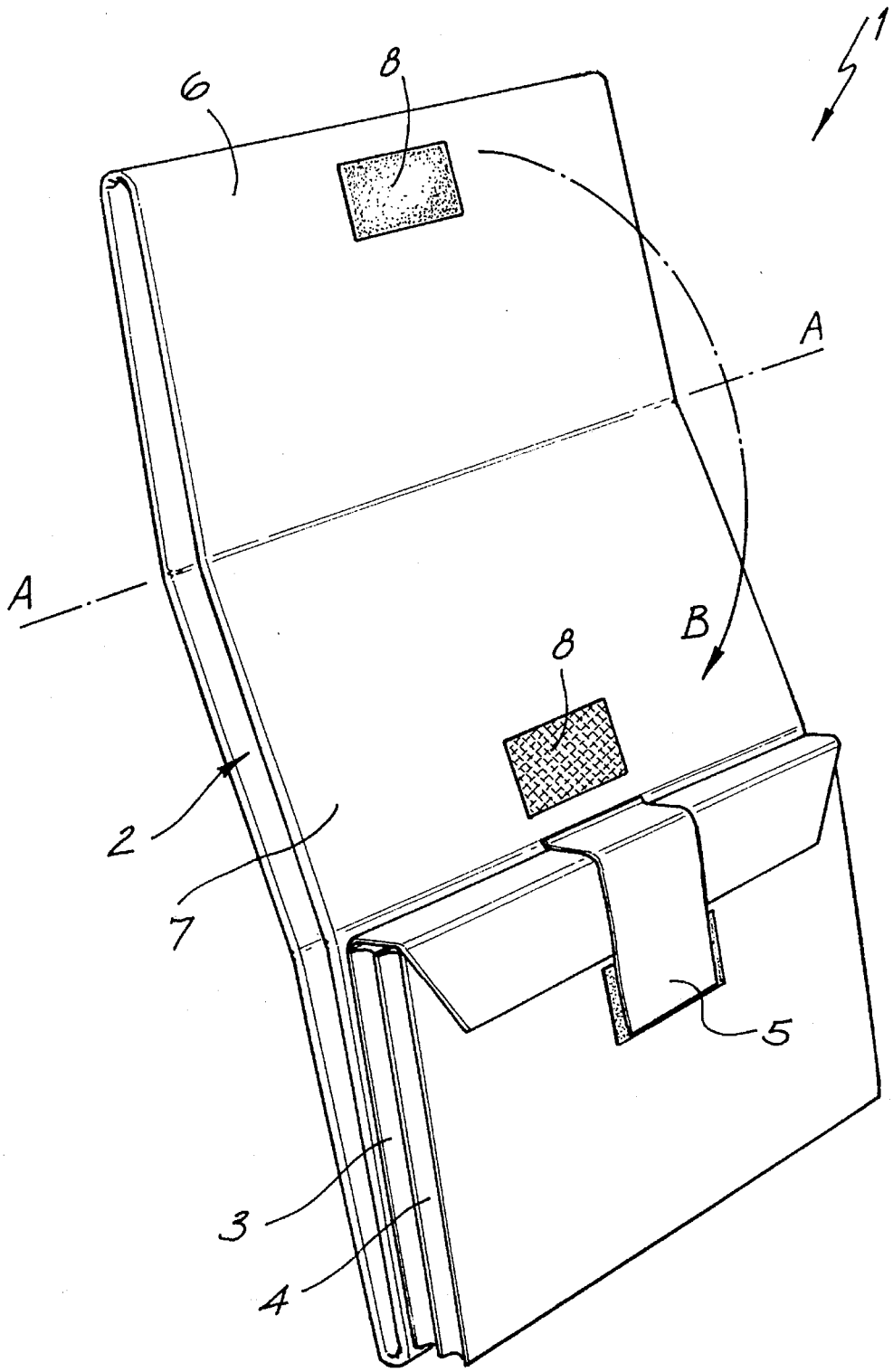
FIG. 1 is a perspective view of one embodiment of a wallet of the present invention in an unfolded condition.

FIG. 1 shows a wallet (1), of an embodiment of the wallet and pouch combination of the present invention, in an unfolded condition. The wallet (1) has a note compartment (2), a credit card compartment (3) and a coin/key compartment (4). The credit card compartment (3) and the coin/key compartment (4) covers one third the length of the wallet (1), and is provided with a strap/cover (5) to ensure that items held therein do not fall out.

The note compartment (2), which runs the length of the wallet (1), has a free end portion (6) which is substantially one third of the length of the wallet (1) and a intermediate portion (7), which is also substantially one third the length of the wallet (1).

The free end portion (6) and the intermediate portion (7) are provided with hook and loop type fastener tabs (8). The wallet (1) is adapted such that the free end portion (6) can be folded substantially about the line A—A in the direction of arrow B onto the intermediate portion (7). The hook and loop type fastener tabs (8) allowing for the free end portion (6), to be attached to and held against the intermediate portion (7) as shown in FIG. 2.

Figure 2:
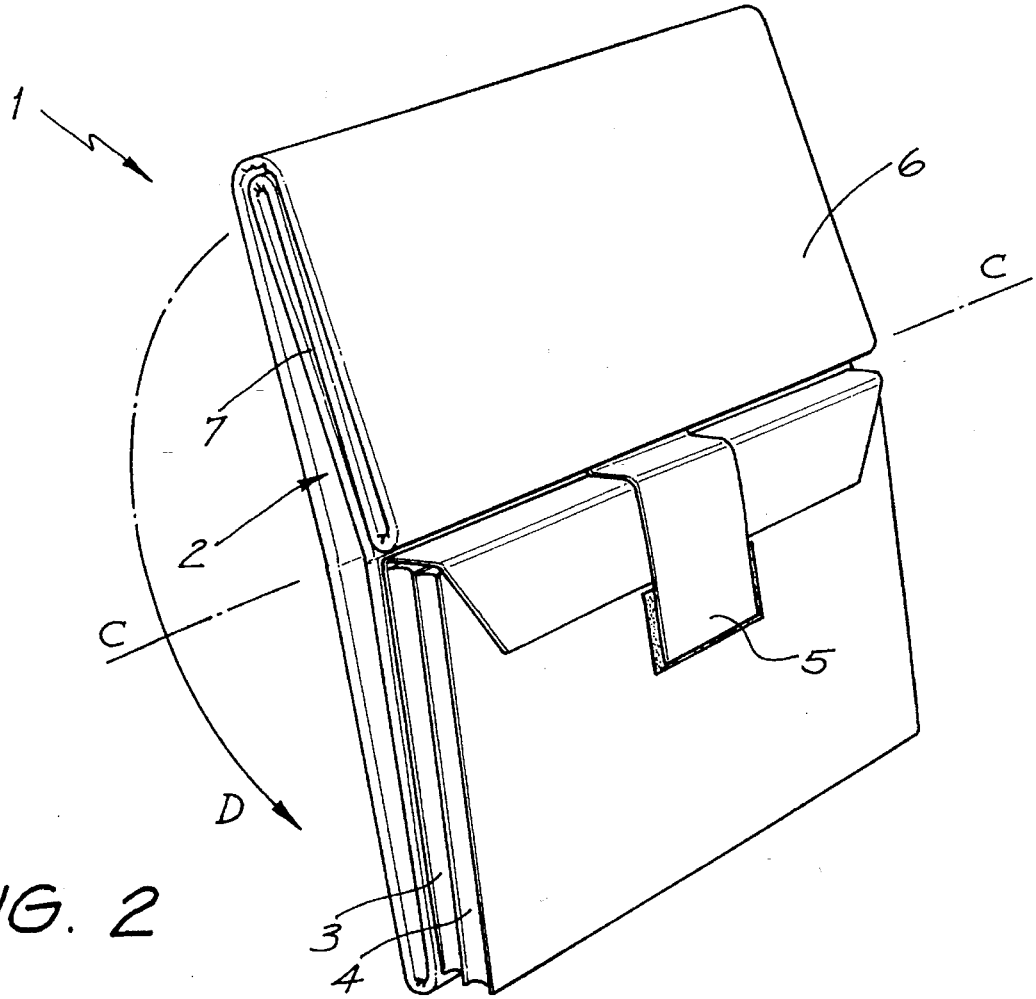
FIG. 2 is a perspective view of the wallet of FIG. 1 in a first folded configuration.
Figure 3:
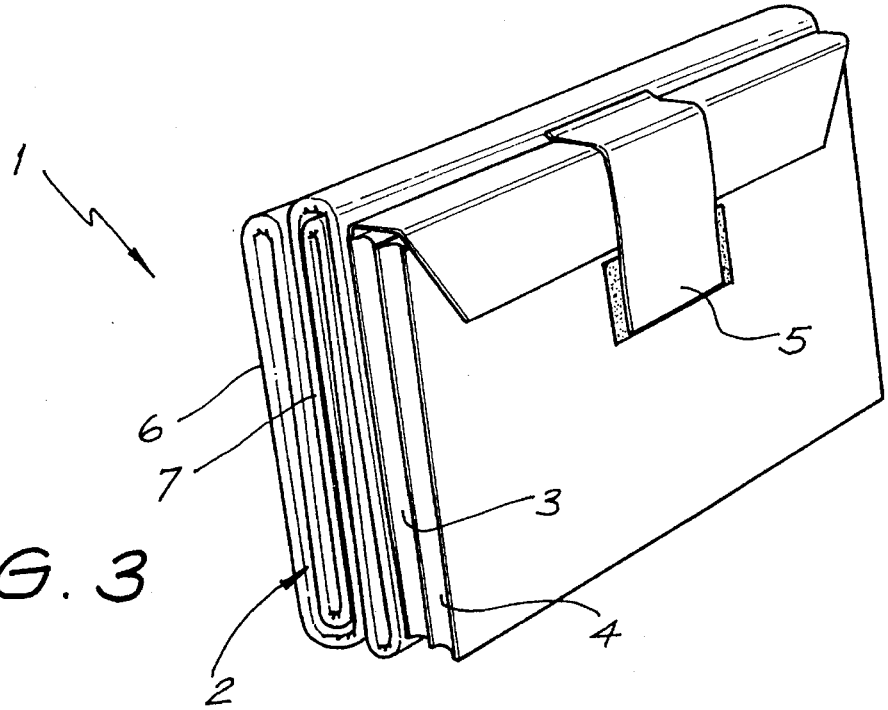
FIG. 3 is a perspective view of the wallet of FIG. 1 in a second folded position.

As shown in FIG. 2, the free end portion (6) and the attached intermediate portion (7) can be further folded about the line C—C in the direction of the arrow D, thereby reducing the wallet (1) to substantially one third its length, as shown in FIG. 3.

Figure 4:
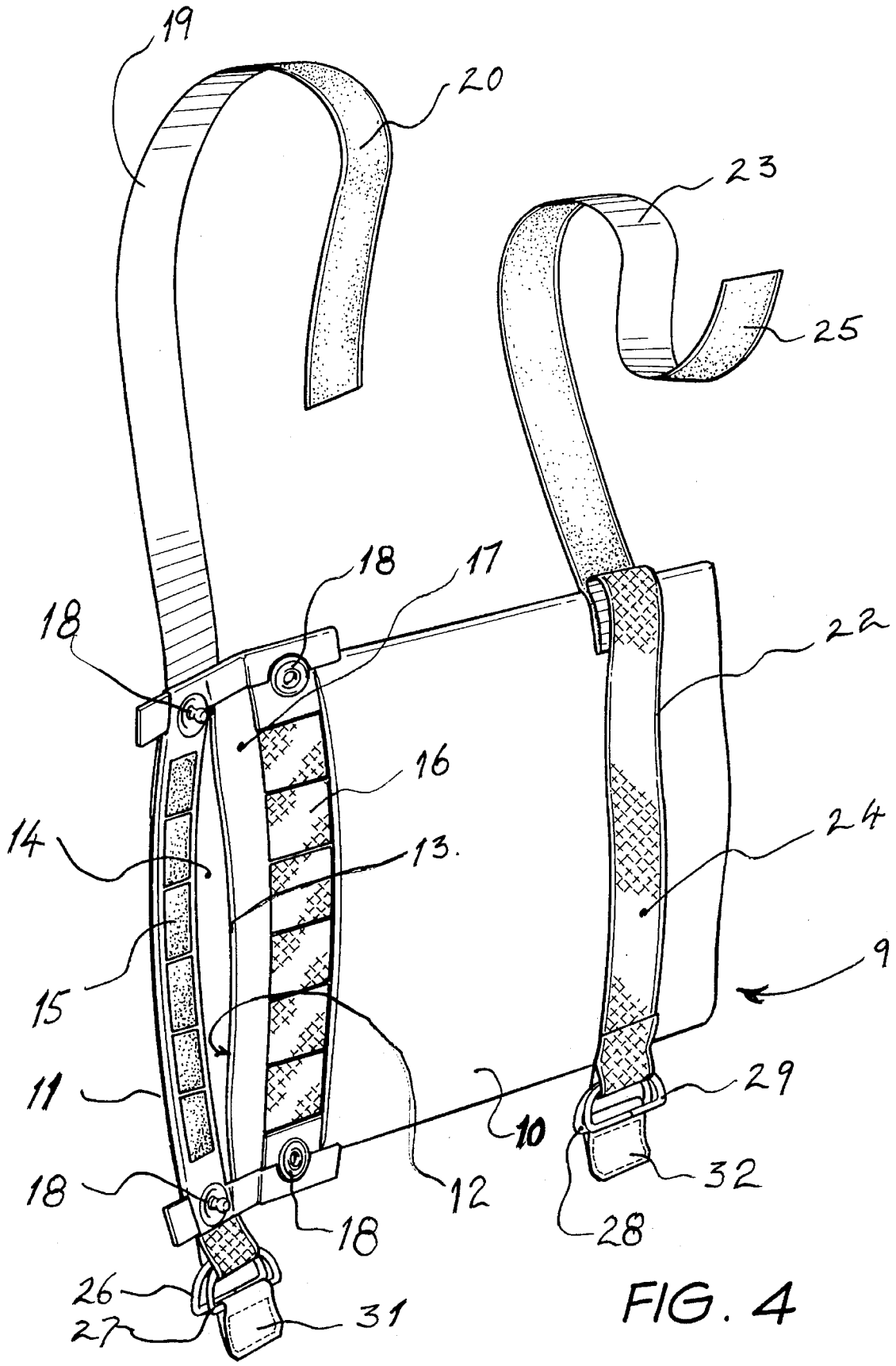
FIG. 4 is a perspective view of a pouch according to an embodiment of the present invention.

One embodiment of a pouch (9) is shown in FIG. 4. The pouch (9) is made from waterproof material and has a front member (10) and a back member (11) with an opening (12) formed along one side (13) of the front member (10). The back member (11) has an extension portion (14) which extends beyond the side (13) of the front member (10). Located on the front surface of the extension portion (14) is a hook and loop type fastener strip (15), which fastens onto a receptive hook and loop type fastener strip (16) on the front of the front member (10).

Figure 5:
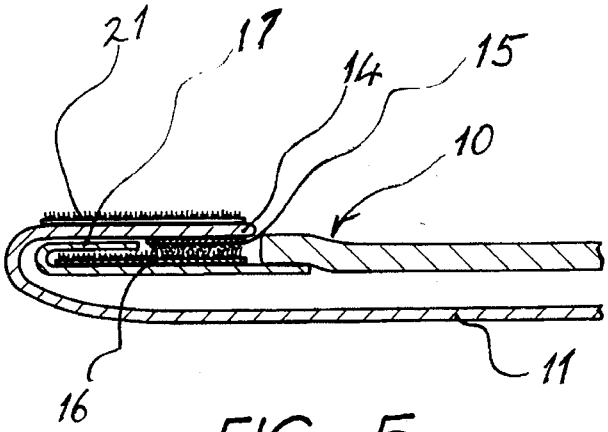
FIG. 5 is cross sectional view across the opening of the pouch of FIG. 4.

The wallet (1) is placed into the opening (12) and the extension portion (14) is, as shown in FIG. 5, closed over the opening (12) with the two hook and loop type fastener strips (15 & 16) securing the sealing. As shown in FIG. 5, the edge portion (17) of the front member (10) is folded back on the front member (10) beneath the back member (11), to improve the water resistance of the sealing of the opening (12). Additionally, press stud type fasteners (18) can be used to assist in the sealing.

Extending from one side of the extension portion (14) is a strap (19) having a hook and loop type fastener strip (20). Located on the back of the extension portion (14) is a receptive hook and loop type fastener strip (21).

Located towards the other end of the pouch (9) is a second strap (22), which is connected only adjacent its ends to the front of the front member (10), such that it passes over the front of the front member (10). Because the strap (22) is unattached to the front of the front member (10) there is no interference by the strap (22) of the flexibility of the pouch (9). A hook and loop type fastener (24) is located thereon.

Extending from the side of the pouch (9), adjacent the connection of the strap (22) is a strap (23), having a hook and loop type fastener (25) located thereon. Located opposite each strap (19 & 23) are two d-shaped ring members (26 & 27) and (28 & 29)

Figure 6:
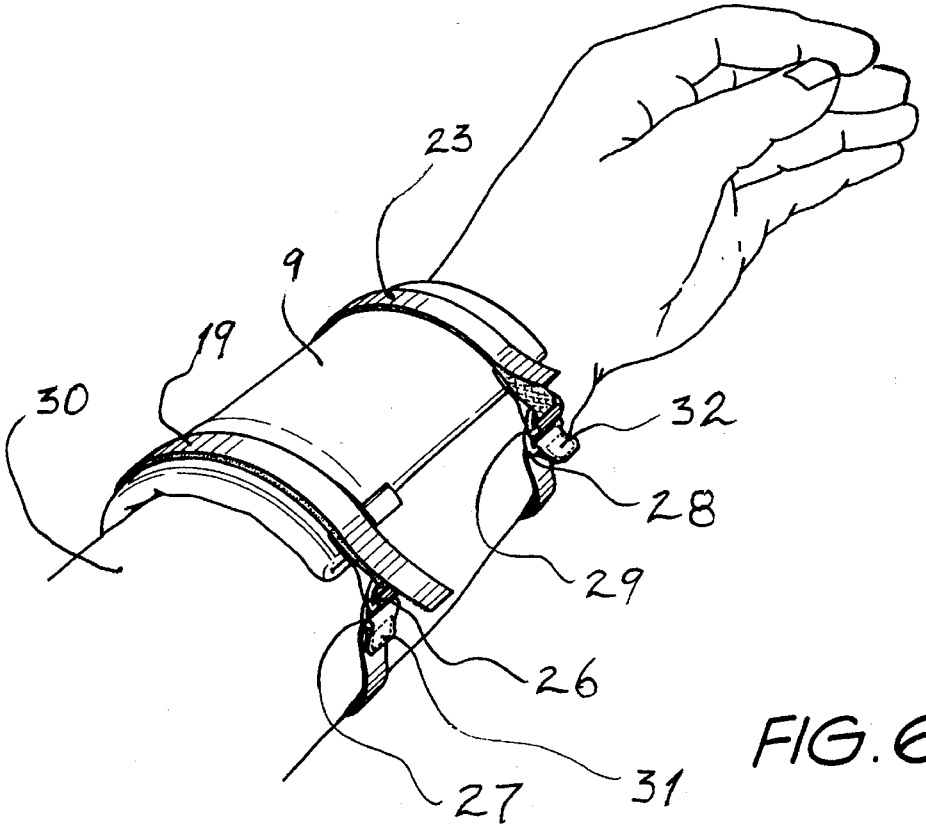
FIG. 6 is a perspective view of the pouch of FIG. 4 fully secured to the wrist of a user.

To secure the pouch (9) to the wrist of a user, as shown in FIG. 6, the back of the pouch (9) is placed against the wrist or lower forearm (30) of a user and the straps (19 & 23) are passed over the respective rings (26 & 29) and under the respective rings (27 & 28). The straps (19 & 23) are then pulled to the required tightness around the wrist, locking between the respective rings (26 & 27) and (28 & 29), and secured by their respective hook and loop type fasteners (20 & 25) to the hook and loop type fastener (21) on the back of the extension portion (14) and the hook and loop type fastener (24) on the loose strap (22).

Tabs (31 & 32) are secured to the respective rings (27 & 28) to assist in the releasing of the straps (19 & 23) from the respective rings (26 & 27) and (28 & 29).

The invention claimed is:

1. A waterproof wallet and pouch combination, adapted to be worn around the wrist of a user;

wherein said pouch comprises: a front member; and a back member forming a cavity there between, said back member having an extension portion which extends on one side beyond the respective side of said front member and forming an opening into the cavity, along the respective side of said front member;

a first hook and loop type fastener located on the front of said extension portion of said back member;

a second hook and loop type fastener located on the front of said front member adjacent said opening of the pouch; whereby said hook and loop type fasteners releaseably seal to each other, with said extension portion of said back member folded over and sealing said opening, with a portion of said front member between said opening and said second hook and loop type fastener folding back on itself;

a third hook and loop type fastener located on the back of said extension portion of said back member;

a first strap, having a fourth hook and loop type fastener thereon, extending from one side edge of said extension portion of said back member;

a first ring member located on the other side edge of said extension portion of said back member;

a second strap being connected, adjacent its free ends, to said pouch, adjacent the side edges of said pouch, and extending free across the front of the front member of said pouch substantially parallel to said opening;

a fifth hook and loop type fastener located on said second strap;

a third strap having a sixth hook and loop type fastener thereon extending from one side edge of said pouch adjacent said second strap;

a second ring member located on the other side edge of said pouch adjacent said second strap;

whereby, in use, the back member of the pouch is against the wrist of the user, and the first strap passes through the first ring member with the fourth hook and loop type fastener thereon being releasably secured to the third hook and loop type fastener, and the third strap passes through the second ring member, with the sixth hook and loop type fastener thereon being releaseably secured to the fifth hook and loop type fastener, thereby securing the pouch to the wrist of the user;

wherein said cavity is adapted to removably hold said wallet therein, when the wallet is in its folded configuration, and wherein said wallet comprises three substantially equal in length flexible sections, extending along the length of the wallet, said sections being a first end section, a middle section, and a second end section; and said wallet further comprises a first compartment extending along all three sections, and at least a second compartment located on the first end section, whereby the wallet is in its folded configuration when said second end section is folded over the middle section.

2. A waterproof wallet and pouch combination according to claim I further comprising, press stud type fasteners located adjacent said first and second hook and loop type fasteners for assisting in sealing said opening.

3. A waterproof wallet and watch combination according to claim 1 wherein each of said ring members comprises two d-shaped rings.

4. A pouch and wallet combination according to claim 1 wherein said wallet includes another compartment, located on the first end section for holding credit cards.

* * * * *